US007801278B2

(12) United States Patent
Ito et al.

(10) Patent No.: US 7,801,278 B2
(45) Date of Patent: Sep. 21, 2010

(54) ROTARY ANODE X-RAY TUBE

(75) Inventors: Yasutaka Ito, Kawasaki (JP); Hitoshi Hattori, Yokohama (JP); Yasuo Yoshii, Kawasaki (JP); Chiharu Tadokoro, Machida (JP); Hironori Nakamuta, Otawara (JP); Tetsuya Yonezawa, Yaita (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 4 days.

(21) Appl. No.: 12/408,514

(22) Filed: Mar. 20, 2009

(65) Prior Publication Data

US 2009/0245469 A1 Oct. 1, 2009

(30) Foreign Application Priority Data

Mar. 26, 2008 (JP) ..... 2008-080973

(51) Int. Cl.
*H01J 35/00* (2006.01)
*H01J 35/10* (2006.01)

(52) U.S. Cl. ..... 378/133; 378/132; 378/144

(58) Field of Classification Search ..... 378/119, 378/123, 125, 133, 143, 144, 132
See application file for complete search history.

(56) References Cited

U.S. PATENT DOCUMENTS

| | | | | |
|---|---|---|---|---|
| 5,541,975 | A | 7/1996 | Anderson et al. | |
| 5,838,763 | A | 11/1998 | Hiller et al. | 378/133 |
| 6,751,291 | B2 * | 6/2004 | Nakamuta et al. | 378/132 |
| 7,215,740 | B2 * | 5/2007 | Fukushima et al. | 378/126 |
| 7,324,629 | B2 * | 1/2008 | Fukushima et al. | 378/126 |
| 2004/0234033 | A1 * | 11/2004 | Anno et al. | 378/133 |
| 2009/0080616 | A1 | 3/2009 | Yoshii et al. | 378/133 |

FOREIGN PATENT DOCUMENTS

| | | |
|---|---|---|
| JP | 8096889 | 12/1996 |
| JP | 3139873 | 5/2001 |

* cited by examiner

*Primary Examiner*—Irakli Kiknadze
(74) *Attorney, Agent, or Firm*—Ohlandt, Greeley, Ruggiero & Perle, L.L.P.

(57) ABSTRACT

In an X-ray tube, a rotary anode formed into a hollow disk-like shape is fixedly supported by a rotating body formed into a hollow cylindrical shape. A fixed shaft has fixed ends, columnar bearing portions and a disk part, and a flow path of a cooling medium formed along a central axis thereof. The bearing portions are inserted into the rotating body with a first gap between the columnar bearing portion and the rotating body, so that the rotating body is rotatably supported. The disk part is arranged in the rotary anode with a second gap between the disk part and the rotary anode. The first and second gaps are filled with a lubricant, bearing grooves are formed in the bearing portion, thereby forming dynamic pressure bearings, and a center of gravity of the rotary anode is arranged between the first and second dynamic pressure bearings.

5 Claims, 2 Drawing Sheets

ROTARY ANODE X-RAY TUBE

CROSS-REFERENCE TO RELATED APPLICATIONS

This application is based upon and claims the benefit of priority from prior Japanese Patent Application No. 2008-080973, filed Mar. 26, 2008, the entire contents of which are incorporated herein by reference.

BACKGROUND OF THE INVENTION

1. Field of the Invention

The present invention relates to a rotary anode X-ray tube in which a rotating body is rotatably supported by means of dynamic pressure bearings on a fixed shaft supported on both sides thereof.

2. Description of the Related Art

In general, an X-ray tube device is used for a medical diagnosis system, an industrial diagnosis system, and the like. A rotary anode X-ray tube used in a medical diagnosis system is, as disclosed in Japanese Patent No. 3139873, operated in a severe use environment in which the tube is rotated at a high speed at a high temperature, and in a vacuum. In the X-ray tube disclosed in Japanese Patent No. 3139873, a fixed shaft is fixed on a cantilever-support member, a rotating body is fitted on the fixed shaft, and rotating body is rotatably supported by dynamic pressure bearings. The dynamic pressure bearings are provided between the rotating body and the fixed shaft with a liquid metal lubricant, wherein a liquid metal lubricant is applied in a gap between the inner surface of the rotating body and the outer surface of the fixed shaft to form the dynamic pressure bearing. The rotating body is rotated so that a dynamic pressure is generated in the liquid metal lubricant in the dynamic pressure bearings. Thus, the dynamic pressure stably supports the rotating body on the fixed body. By using the dynamic pressure bearings, it is possible to rotate the anode target at a high speed.

Further, reduction in size and weight is required of the X-ray tube and, in order to achieve the reduction in size and weight, it is necessary to cool the target through the liquid metal. In U.S. Pat. No. 5,541,975, there is disclosed an X-ray tube in which a fixed shaft is supported by a cantilever structure and a rotating body is rotatably supported on the fixed shaft by ball bearings. In this X-ray tube, the fixed shaft is formed into a hollow structure, a cooling pipe is inserted in the fixed shaft, a cooling liquid is supplied to the inside of the fixed shaft through the cooling pipe, and the fixed shaft is cooled by the cooling liquid so that the rotating body can be cooled.

Likewise, in JP-A H08-96889 (KOKAI), there is disclosed an X-ray tube in which a rotating body is rotatably supported on both sides of a fixed shaft with utilizing ball bearings. In this X-ray tube, the fixed shaft is formed into a cylindrical shape, and a cooling liquid is supplied in the inside space of the cylinder to cool a connector on the high-voltage side.

Furthermore, in U.S. Pat. No. 5,838,763, there is disclosed an X-ray tube in which a fixed shaft is supported at both ends thereof. In this X-ray tube, dynamic pressure bearings are provide between a rotating body and the fixed shaft wherein a liquid metal lubricant is applied to a gap between the inner surface of a rotating body and the outer surface of the fixed shaft. Furthermore, the fixed shaft is formed into a cylindrical shape, and a cooling liquid is supplied to the inside space of the cylinder, whereby the rotating body is cooled.

In the X-ray tube disclosed in Japanese Patent No. 3139873, heat is transmitted from the anode target to the fixed shaft which is supported by the cantilever structure, and heat is accumulated and held in the dynamic pressure bearings. Thus, there is the possibility of the bearing reaching a high temperature, and the possibility of the bearing capability being lowered. Accordingly, the structure of the X-ray tube disclosed in Japanese Patent No. 3139873 (KOKAI) is regarded as being unsuitable for reduction in size and weight.

The X-ray tube disclosed in U.S. Pat. No. 5,541,975 has a structure for cooling the connector on the high-voltage side, and the rotating body is constituted of a cylindrical body part on the bearing side, and a cylindrical body part supporting the anode target. In the rotating body, a space is formed between both the cylindrical body parts, thereby forming a structure in which heat from the anode target is hardly transmitted to the fixed shaft. Furthermore, the bearing is constituted of a ball bearing, the rotating body side of the duplicate cylindrical structure is in point contact with the fixed shaft, and hence there is the problem that heat generated at the anode target is hardly transmitted to the fixed shaft, and it is difficult to effectively cool the anode target and the rotating body.

In the X-ray tube disclosed in JP-A H08-96889 (KOKAI), the rotating body is supported with utilizing ball bearings. Although the fixed shaft supported by the cantilever structure can be cooled by the cooling liquid flowing through the inside thereof, the rotating body supporting the anode target is in contact with the fixed shaft through the ball bearing with which the rotating body is in point contact, and hence heat generated from the anode target is hardly transmitted to the fixed shat, thereby posing the problem that it is difficult to effectively cool the anode target and the rotating body.

In the X-ray tube disclosed in U.S. Pat. No. 5,838,763, the cooling liquid flows through the one-way flow path along the fixed shaft, and hence it is possible to increase the inflow/outflow amount, and enhance the cooling capability of the X-ray tube provided with the dynamic pressure bearings. However, the X-ray tube has a structure in which the center of gravity of the anode target is arranged outside the bearing portion, and thus the anode target is arranged between the bearing portion and the cathode. Accordingly, when the anode target having a large weight is rotated with slight eccentricity, there is the problem that the rotating body is easily vibrated, and moreover the reliability of the bearing portion is lowered.

BRIEF SUMMARY OF THE INVENTION

According to an aspect of the present invention, there is provided a rotary anode X-ray tube having a center axis, comprising:

a cathode for emitting an electron beam;

a rotary anode formed into a hollow disk-like shape, which is provided with a target on which the electron beam is irradiated to generate an X-ray, the rotary anode having a disk-like inner surface;

a rotating body formed into a hollow cylindrical shape, which supports the rotary anode and has a cylindrical inner surface;

a fixed shaft having fixed at both end portions, which is so arranged as to be inserted into the rotating body and to rotatably support the rotating body, the fixed shaft having a disk portion and columnar bearing parts integrally formed with the disk portion and extending along the center axis from the disk portion, the columnar bearing parts having outer surfaces facing the cylindrical inner surface with a first gap, the disk portion having a outer surface opposed to the disk-like inner surface with a second gap communicating with the first gap, wherein the fixed shaft is so formed into a hollow structure as to have a flow path in which a cooling medium to be supplied along the center axis;

a lubricant which is applied to the first and second gaps; and first and second dynamic pressure bearings each of which is formed on the outer surfaces of the bearing parts, which includes bearing grooves formed on at least one of the cylindrical inner surface and the outer surfaces of the bearing parts and the lubricant in the first gap, wherein a center of gravity of the rotary anode is arranged between the first and second dynamic pressure bearings.

DETAILED DESCRIPTION OF THE INVENTION

An X-ray tube according to an embodiment of the present invention will be described below with reference to the accompanying drawings.

First Embodiment

Figure 1:
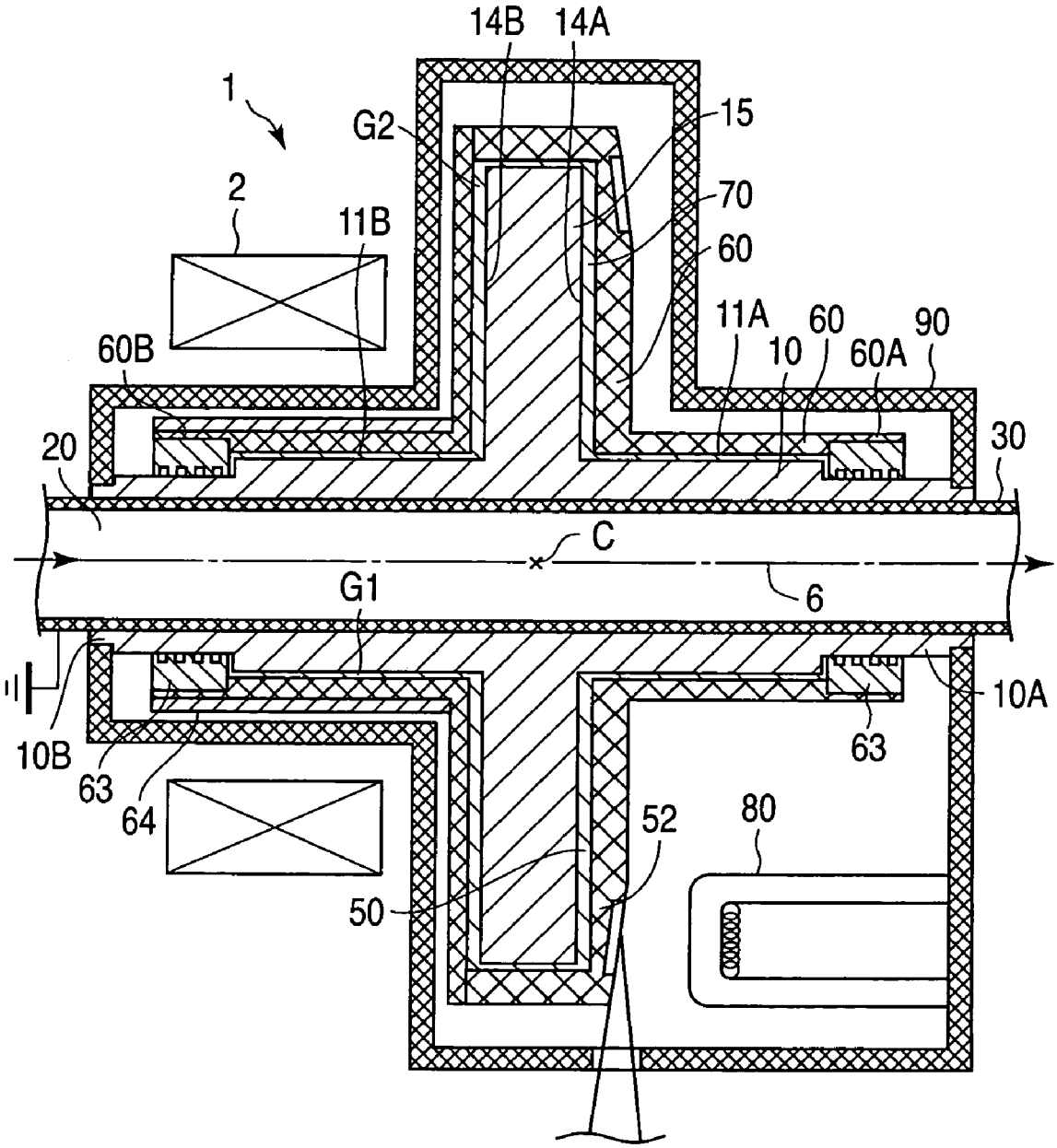
FIG. 1 is a cross-sectional view schematically showing the structure of a rotary anode X-ray tube having a both-side support bearing structure according to an embodiment.

FIG. 1 shows a rotary anode X-ray tube having a both-side support bearing structure according to a first embodiment of the present invention. A rotary anode X-ray tube 1 is provided with a housing (not shown) for an X-ray tube apparatus. A stator coil 2 for generating a rotating magnetic field is located in the housing. The rotary anode X-ray tube 1 includes a vacuum envelope 90, and the stator coil 2 for generating a rotating magnetic field is arranged on the outer circumference of the vacuum envelope 90. The inside of the vacuum envelope 90 is maintained vacuum. A fixed shaft 10 is so arranged in the vacuum envelope 90 as to extend along a central axis 6 of the rotary anode X-ray tube 1, which is substantially aligned with a central axis of the fixed shaft 10, and the vacuum envelope 90 is air-tightly sealed at both end sections 10A and 10B of the fixed shaft 10. Further, inside the vacuum envelope 90, a rotating body 60 rotatably supported on the fixed shaft 10 is arranged, and an anode target 50 rotated together with the rotating body 60 is fixed to the rotating body 60. The anode target 50 is made of a heavy metal, and has a weight larger than the other components. Further, a center of gravity C of the anode target 50, which substantially coincides with the center of gravity of the rotating body 60, is determined on the central axis 6, and the center of gravity of the rotating body 60, i.e., the center of gravity of the anode target 50 is positioned between a pair of radial bearings 11A and 11B to be described later, for rotatably supporting the rotating body 60 on the fixed shaft 10, or is positioned preferably at a center between the pair of radial bearings 11A and 11B.

The fixed shaft 10 is formed into a cylinder, and a cooling pipe 30 for defining a flow path of a cooling liquid 20 is inserted into the cylinder to be fitted therein. The cooling liquid 20 is supplied to the flow path in the cooling pipe 30 by a pump (not shown) as indicated by an arrow, and the cooling liquid cooled outside the X-ray tube apparatus is circulated again through the flow path of the cooling pipe 30 through the pump. The fixed shaft 10 is provided with a disk part 15 having a central axis coinciding with the central axis 6, and the disk part 15 is integrated with the fixed shaft 10. The disk part 15, like the anode target 50, is arranged between the pair of radial bearings 11A and 11B.

The fixed shaft 10 is inserted into the cylindrical rotating body 60 to be fitted therein, a gap G1 is provided between the inner surface of the rotating body 60 and the outer surface of the fixed shaft 10, and the gap G1 is filled with a liquid metal lubricant 70. Grooves (not shown) having a herringbone pattern or the like are formed on one of the inner surface of the rotating body 60 and the outer surface of the fixed shaft 10, thereby forming a radial dynamic pressure bearing 11A, 11B. In the radial dynamic pressure bearing 11A, 11B, the liquid metal lubricant 70 is drawn into the grooves concomitantly with the rotation of the rotating body 60, and the dynamic pressure of the liquid metal lubricant 70 is raised, whereby the rotating body 60 is supported in the radial direction of the fixed shaft 10.

The disk part 15 is fitted in the anode target 50 having a hollow disk-like shape, and fixed to the cylindrical rotating body 60 so that a gap G2 communicating with the gap G1 can be provided between the inner surface of the anode target 50 and the outer surface of the disk part 15. The gap G2 is filled with a liquid metal lubricant 70 as the gap G1, and on one of the inner surface of the anode target 50 and the outer surface of the disk part 15, a groove (not shown) having a spiral shape or the like is formed, whereby a thrust dynamic pressure bearing 14A, 14B is formed between the anode target 50 and the disk part 15. In the thrust dynamic pressure bearing 14A, 14B, the liquid metal lubricant 70 is drawn into the spiral groove concomitantly with the rotation of the rotating body 60, the dynamic pressure of the liquid metal lubricant 70 is raised, and the rotating body 60 is supported in the thrust direction of the fixed shaft 10, whereby the gap G2 is maintained substantially constant. On the inner surfaces of both the end sections 60A and 60B, seal rings 63A and 63B are provided, and the outer surfaces of both the end sections 10A and 10B of the fixed shaft 10 are liquid-tightly sealed with respect to the counter surfaces of both the end sections 10A and 10B of the fixed shaft 10 by the seal rings 63A and 63B. Accordingly, the liquid metal lubricant 70 is sealed up inside the gaps G1 and G2 between the fixed shaft 10 and the rotating body 60, and is prevented from leaking out of the gap G1. It is preferable that the seal rings 63A and 63B also be arranged symmetrical with respect to the center of gravity C.

On the outer surface of the cylindrical section of the cylindrical rotating body 60, a motor rotor 64 is fixed to be opposed to the motor stator 2 arranged outside the vacuum envelope 90, torque is generated on the motor rotor 64 on the basis of the rotating magnetic field supplied from the motor stator 2 to the motor rotor 64, and the rotating body 60 is rotated. Further, a cathode 80 is arranged inside the vacuum envelope 90 so as to be opposed to an electron bombardment surface 52 on the outer surface of the anode target 50, and the electron bombardment surface 52 of the anode target 50 is bombarded with an electron beam emitted from the cathode 80, whereby an X-ray is generated from the electron bombardment surface 52. The generated X-ray is radiated outside the X-ray tube through an X-ray window provided in the vacuum envelope 90.

As described above, in the rotary anode X-ray tube shown in FIG. 1, the liquid metal 70 is used as a heat-conducting fluid, and is made to flow through the cooling pipe 30 in one direction. Furthermore, the anode target 50, and the rotating body 60 to which the anode target 50 is fixed are in contact with the disk part 15 and the fixed shaft 10 through the liquid metal lubricant 70 filled into the gaps G1 and G2. Accordingly, heat generated from the anode target 50 is transmitted to the fixed shaft 10 through the liquid metal lubricant 70 and the disk part 15. The heat transmitted to the fixed shaft 10 is transmitted to the cooling liquid 20 flowing through the inside thereof, and is discharged to the outside of the X-ray tube 1.

Although the heat generated from the anode target 50 is transmitted to the liquid metal lubricant 70 inside the gaps G1 and G2, the liquid metal lubricant 70 is cooled by the cooling liquid 20 made to flow through the cooling pipe 30 through the fixed shaft 10. Accordingly, the pair of radial bearings 11A and 11B can rotatably support the rotating body 60 securely without generating air bubbles from the heated liquid metal lubricant. Furthermore, a center of gravity of the rotating body 60, i.e., a center of gravity of the anode target 50 is determined between the pair of radial bearings 11A and 11B, and hence equal loads are applied to the pair of radial bearings 11A and 11B from the anode target 50, whereby it is possible to prevent the anode target 50 from being rotated with eccentricity, and rotatably support the rotating body 60 securely.

Second Embodiment

Figure 2:
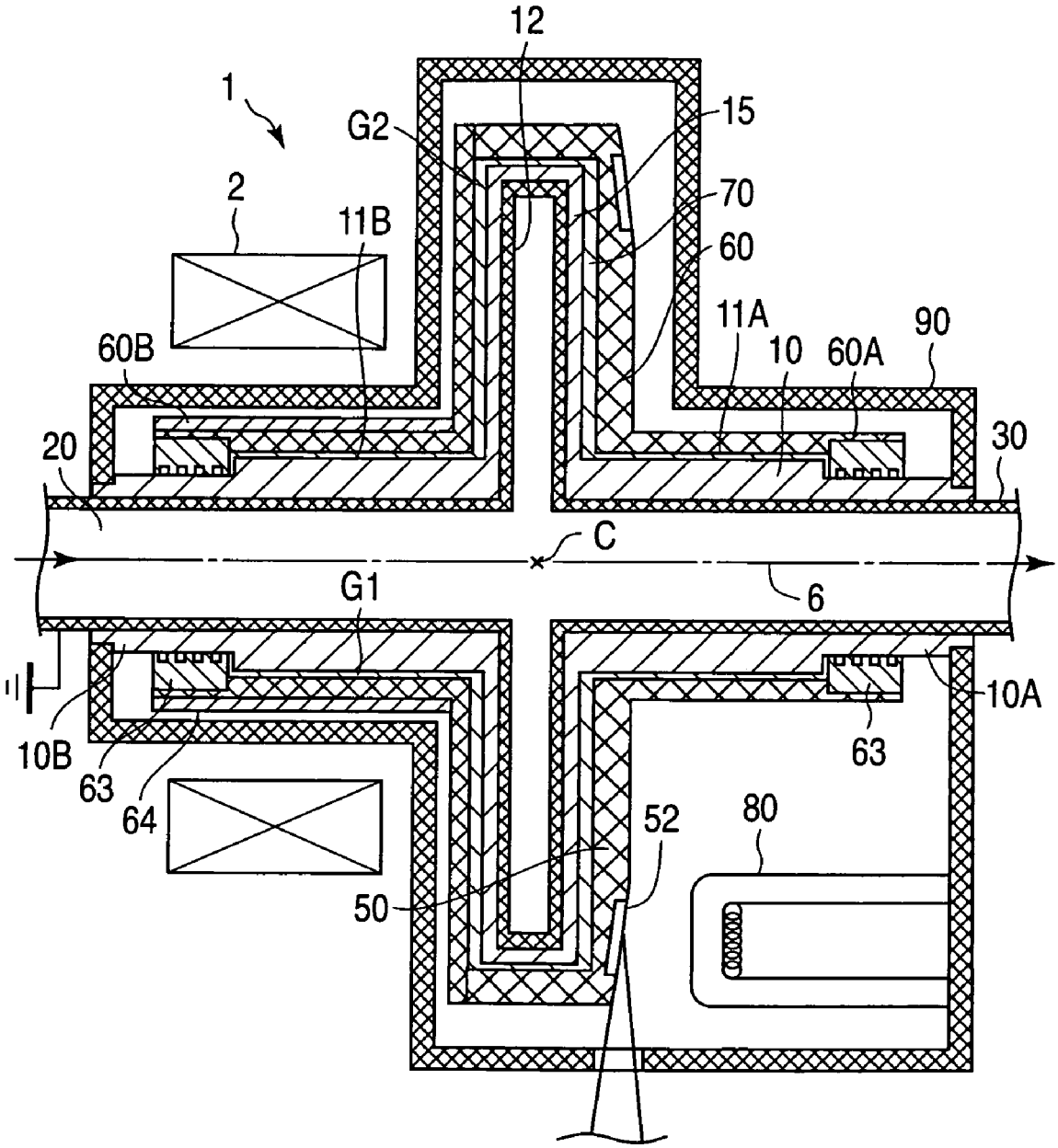
FIG. 2 is a cross-sectional view schematically showing the structure of a rotary anode X-ray tube having a both-side support bearing structure according to another embodiment.

FIG. 2 shows a rotary anode X-ray tube according to another embodiment of the present invention. In FIG. 2, the same reference symbols as those shown in FIG. 1 show the same parts or the same points, and descriptions of them will be omitted.

In the X-ray tube shown in FIG. 2, a cavity section is also provided in a disk part 15, and a cooling pipe 30 is expanded into a disk-like shape so as to constitute a cooling container 12 inside the cavity section. A flow path is provided in the cooling container 12 in an annular shape so that the annular flow path can communicate with a flow path defined by a cooling pipe 30 inserted into a cylindrical body of a fixed shaft 10 to be arranged therein, and a cooling liquid 20 is made to flow also into the annular flow path from the flow path inside the cooling pipe 30. Accordingly, the cooling container 12 has a function of cooling an anode target 50, heat generated from the anode target 50 is transmitted to the cooling liquid 20 in the cooling container 12 through a gap G2, and the thus transmitted heat is carried out of the X-ray tube through the cooling liquid 20 made to flow through the cooling pipe 30.

In the X-ray tube shown in FIG. 2, the cooling container 12 to which the cooling liquid 20 is supplied is provided in the anode target 50, and heat is transmitted to the cooling container 12 through a liquid metal lubricant 70 in the gap G2, whereby it is possible to effectively cool the anode target 50.

Accordingly, in the X-ray tube shown in FIG. 2, a pair of radial bearings 11A and 11B can rotatably support a rotating body 60 securely, and also thrust dynamic pressure bearings 14A and 14B can rotatably support the rotating body 60 securely. Furthermore, a center of gravity of the rotating body 60, i.e., a center of gravity of the anode target 50 is determined between the pair of radial bearings 11A and 11B, and hence equal loads are applied to the pair of radial bearings 11A and 11B from the anode target 50, whereby it is possible to prevent the anode target 50 from being rotated with eccentricity, and rotatably support the rotating body 60 securely.

As has been described above, according to the X-ray tube of the present invention, the cooling pipe penetrates the fixed shaft for supporting the rotating body on both sides thereof. Therefore, it is possible to facilitate the inflow/outflow of the cooling liquid through the cooling pipe, and enhance the cooling efficiency of the heat to be accumulated in the X-ray tube. Since the cooling pipe penetrates the fixed shaft, the pressure loss is reduced, and reduction in size of the pump for the cooling liquid is enabled. Further, the rotating anode is supported on both sides thereof, and the target having a large weight is arranged between the bearings, whereby the reliability/vibration stability of the bearings can be enhanced. As a result of this, an X-ray tube excellent in cooling capability/bearing reliability/vibration stability can be realized.

In the X-ray tube according to the examples, the cooling pipe is arranged to penetrate the fixed shaft for supporting the rotating body on both sides thereof, and hence it is possible to facilitate the inflow/outflow of the cooling liquid through the cooling pipe, and enhance the cooling efficiency of the heat to be accumulated in the X-ray tube. Since the cooling pipe penetrates the fixed shaft, the pressure loss is reduced, and reduction in size of the pump for the cooling liquid is enabled. Further, the rotating anode is supported on both sides thereof, and the target having a large weight is arranged between the bearings, whereby the reliability/vibration stability of the bearings can be enhanced. As a result of this, an X-ray tube excellent in cooling capability/bearing reliability/vibration stability can be realized.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotary anode X-ray tube having a center axis, comprising:

a cathode for emitting an electron beam;

a rotary anode formed into a hollow disk-like shape, which is provided with a target on which the electron beam is irradiated to generate an X-ray, the rotary anode having a disk-like inner surface;

a rotating body formed into a hollow cylindrical shape, which supports the rotary anode and has a cylindrical inner surface;

a fixed shaft having fixed at both end portions, which is so arranged as to be inserted into the rotating body and to rotatably support the rotating body, the fixed shaft having a disk portion and columnar bearing parts integrally formed with the disk portion and extending along the center axis from the disk portion, the columnar bearing parts having outer surfaces facing the cylindrical inner surface with a first gap, the disk portion having a outer surface opposed to the disk-like inner surface with a second gap communicating with the first gap, wherein the fixed shaft is so formed into a hollow structure as to have a flow path in which a cooling medium to be supplied along the center axis;

a lubricant which is applied to the first and second gaps; and first and second dynamic pressure bearings each of which is formed on the outer surfaces of the bearing parts, which includes bearing grooves formed on at least one of the cylindrical inner surface and the outer surfaces of the bearing parts and the lubricant in the first gap, wherein a center of gravity of the rotary anode is arranged between the first and second dynamic pressure bearings.

2. The rotary anode X-ray tube according to claim 1, wherein the disk portion has a hollow space communicating with the flow path of the cooling medium, and a cooling medium is supplied thereto from the flow path.

3. The rotary anode X-ray tube according to claim 2, wherein the hollow space is formed in a disk-like space.

4. The rotary anode X-ray tube according to claim 1, wherein the rotating body has openings at the both ends, and the X-ray tube further comprises seal portions, provided at the openings, configured to prevent the lubricant from leaking out from the first and second gaps to the outside of the rotating body.

5. The rotary anode X-ray tube according to claim 1, wherein the center of gravity of the rotary anode is located on the center axis.

* * * * *